US009562445B2

(12) United States Patent
Weber

(10) Patent No.: US 9,562,445 B2
(45) Date of Patent: Feb. 7, 2017

(54) CAMSHAFT PHASER

(71) Applicant: Schaeffler Technologies AG & Co. KG, Herzogenaurach (DE)

(72) Inventor: Juergen Weber, Erlangen (DE)

(73) Assignee: Schaeffler Technology AG & Co. KG, Herzogenaurach (DE)

( * ) Notice: Subject to any disclaimer, the term of this patent is extended or adjusted under 35 U.S.C. 154(b) by 0 days.

(21) Appl. No.: 14/787,185

(22) PCT Filed: Feb. 11, 2014

(86) PCT No.: PCT/DE2014/200052

§ 371 (c)(1),
(2) Date: Oct. 26, 2015

(87) PCT Pub. No.: WO2014/173397

PCT Pub. Date: Oct. 30, 2014

(65) Prior Publication Data

US 2016/0102586 A1 Apr. 14, 2016

(30) Foreign Application Priority Data

Apr. 26, 2013 (DE) ..... 10 2013 207 622

(51) Int. Cl.
*F01L 1/34* (2006.01)
*F01L 1/344* (2006.01)

(52) U.S. Cl.
CPC ..... *F01L 1/344* (2013.01); *F01L 1/3442* (2013.01)

(58) Field of Classification Search
CPC ..... F01L 1/344; F01L 1/3442
USPC ..... 123/90.17
See application file for complete search history.

(56) References Cited

U.S. PATENT DOCUMENTS

| | | | |
|---|---|---|---|
| 2008/0127921 | A1 | 6/2008 | Kleiber |
| 2009/0250026 | A1 | 10/2009 | Ottersbach |

FOREIGN PATENT DOCUMENTS

| | | |
|---|---|---|
| DE | 4040486 | 1/1992 |
| DE | 102010050833 | 5/2012 |
| DE | 102011083603 | 3/2013 |
| WO | WO2006/074744 | 7/2006 |

*Primary Examiner* — Zelalem Eshete
(74) *Attorney, Agent, or Firm* — Davidson, Davidson & Kappel, LLC

(57) ABSTRACT

A camshaft adjuster (1) having a drive element (2) and an output element (3), wherein the drive element (2) and the output element (3) are arranged so as to be rotatable relative to one another and the camshaft adjuster (1) has a covering element (4) which is non-rotatably connected to the drive element (2) or to the output element (3), wherein the drive element (2) or the output element (3) has a bore (5) penetrated by a screw (6), wherein the screw (6) fastens the covering element (4) to the drive element (2) or to the output element (3), wherein the bore (5) tapers in the axial direction (13).

6 Claims, 1 Drawing Sheet

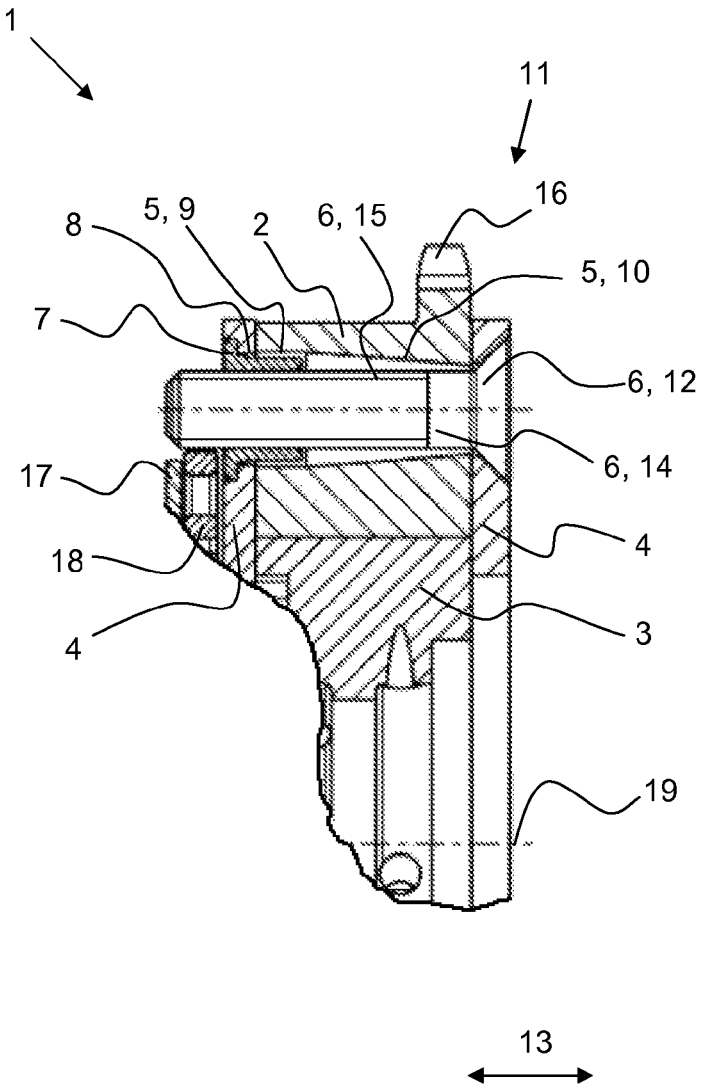
1
11
16
8
5, 9
2
6, 15
5, 10
7
6, 12
6, 14
17
4
18
4
3
19
13

CAMSHAFT PHASER

The present invention relates to a camshaft adjuster.

BACKGROUND

Camshaft adjusters are used in internal combustion engines to vary the control times of the combustion chamber valves to be able to vary the phase relation between a crankshaft and a camshaft in a defined angle range between a maximum advance position and a maximum retard position. Adjusting the control times to the instantaneous load and rotational speed reduces consumption and emissions. For this purpose, camshaft adjusters are integrated into a drive train via which a torque is transferred from the crankshaft to the camshaft. This drive train may be designed, for example, as a belt, chain or gear drive.

In a hydraulic camshaft adjuster, the output element and the drive element form one or multiple pair(s) of counteracting pressure chambers to which a hydraulic medium may be applied. The drive element and the output element are coaxially situated. A relative movement between the drive element and the output element is created by filling and emptying individual pressure chambers. The rotatively acting spring between the drive element and the output element pushes the drive element toward the output element in an advantageous direction. This advantageous direction may be in the same direction or in the opposite direction of the direction of rotation.

One design of the hydraulic camshaft adjuster is the vane adjuster. The vane adjuster includes a stator, a rotor and a drive wheel, which has an external toothing. The rotor as the output element is usually designed to be rotatably fixedly connectable to the camshaft. The drive element includes the stator and the drive wheel. The stator and the drive wheel are rotatably fixedly connected to each other or, alternatively, they are designed to form a single piece with each other. The rotor is situated coaxially with respect to the stator and inside the stator. Together with their radially extending vanes, the rotor and the stator form oppositely acting oil chambers to which oil pressure may be applied and which facilitate a relative rotation between the stator and the rotor. The vanes are either designed to form a single piece with the rotor or the stator or are situated as "plugged-in vanes" in grooves of the rotor or the stator provided for this purpose. The vane adjusters furthermore include various sealing covers. The stator and the sealing covers are secured to each other with the aid of multiple screw connections.

Another design of the hydraulic camshaft adjuster is the axial piston adjuster. In this case, a shifting element, which creates a relative rotation between a drive element and an output element via inclined toothings, is axially shifted with the aid of oil pressure.

A further design of a camshaft adjuster is the electromechanical camshaft adjuster, which has a three-shaft gear set (for example, a planetary gear set). One of the shafts forms the drive element and a second shaft forms the output element. Rotation energy may be supplied to the system or removed from the system via the third shaft with the aid of an actuating device, for example an electric motor or a brake. A spring may be additionally situated, which supports or feeds back the relative rotation between the drive element and the output element.

SUMMARY OF THE INVENTION

It is an object of the present invention to provide an improved camshaft adjuster.

The present invention provides a camshaft adjuster, including a drive element and an output element, the drive element and the output element being rotatably situated relative to each other, and the camshaft adjuster including a cover element, which is rotatably fixedly connected to the drive element or the output element, the drive element or the output element having a bore, which is penetrated by a screw, the screw fastening the cover element to the drive element and output element, the bore tapers in the axial direction.

In one advantageous embodiment, the tapering of the bore is linear. The flux of force in this embodiment is very uniform.

In one preferred embodiment, the tapering of the bore is nonlinear. Advantageously, the flux of force in this embodiment is also uniform and may be influenced by the design of the nonlinearity.

In one embodiment of the present invention, the bore has a cylindrical portion and a tapering portion. A bushing, which has a cylindrical outer diameter, may be advantageously inserted into the cylindrical portion.

In another embodiment of the present invention, the screw engages with a threaded bushing, the threaded bushing projecting into a through-opening of the cover element as well as into the bore of the drive element or the output element. The cover element is advantageously rotatably fixedly connected to the drive element or output element with the aid of the threaded bushing and the screw.

In one preferred embodiment, the threaded bushing projects into the cylindrical portion. The threaded bushing may have sufficient clearance with the cylindrical portion, so that the threaded bushing is still adjustable in the position after it is joined to the screw bore.

In one embodiment of the present invention, the tapered end of the bore is placed on the side of the screw head of the screw. A sufficient surface is thus advantageously made available for the screw head.

Due to the design, according to the present invention, of the screw bore tapering in the axial direction, an optimization of the flux of force is achieved.

BRIEF DESCRIPTION OF THE DRAWINGS

Exemplary embodiments of the present invention are illustrated in the figures.

FIG. 1 shows a camshaft adjuster having the bore according to the present invention.

DETAILED DESCRIPTION

FIG. 1 shows a camshaft adjuster 1 having bore 5 according to the present invention.

Camshaft adjuster 1 includes a drive element 2 and an output element 3. Drive element 2 furthermore includes a toothing 16, via which camshaft adjuster 1 may be driven with the aid of a timing assembly. Output element 3 is designed to be rotatably fixedly connectable to a camshaft, which is not illustrated. Drive element 2 and output element 3 are covered by an axially adjacent cover element 4 on each front side. The two cover elements 4 flank drive element 2 or output element 3. Camshaft adjuster 1 furthermore includes a spring 18, which is adjacent to one cover element 4, and spring cover 17, which is adjacent thereto in axial direction 13. Spring 18 tensions drive element 2 with respect to output element 3 in the circumferential direction.

Drive element 2 has a bore 5, which is situated radially at a distance with respect to rotation axis 19. Corresponding to this bore 5, corresponding openings are provided in the two cover elements 4. Bore 5 is penetrated by a screw 6, which rotatably fixedly connects cover elements 4 to drive element 2. The opening in one cover element 4 is designed is such a way that screw head 12 of screw 6 may be countersunk therein. Opposite cover element 4 includes a threaded bushing 7, with which thread 15 of screw 6 engages. Bore 5 tapers in axial direction 13, tapered end 11 being situated on the side of bore 5 which is penetrated by screw shaft 14 of screw 6. Screw 6 is designed as a countersunk screw. Bore 5 has a tapering portion 10 and a cylindrical portion 9 directly adjacent thereto, which is at least partially penetrated by threaded bushing 7 connected to cover element 4. Threaded bushing 7 is situated in a through-opening 8 designed and provided specifically for this purpose. Bore 5 may be manufactured with the aid of a sintering process or a machining manufacturing process.

LIST OF REFERENCE NUMERALS

1) camshaft adjuster
2) drive element
3) output element
4) cover element
5) bore
6) screw
7) threaded bushing
8) through-opening
9) cylindrical portion
10) tapering portion
11) tapered end
12) screw head
13) axial direction
14) screw shaft
15) thread
16) toothing
17) spring cover
18) spring
19) rotation axis

What is claimed is:

1. A camshaft adjuster comprising:

a drive element;

an output element, the drive element and the output element being rotatably situated relative to each other; and a cover element rotatably fixedly connected to the drive element or to the output element, the drive element or the output element having a bore penetrated by a screw, the screw fastening the cover element to the drive element or the output element, the bore tapering in an axial direction, wherein the screw engages with a threaded bushing, the threaded bushing projecting into both a through-opening of the cover element and the bore of the drive element or the output element.

2. The camshaft adjuster as recited in claim 1 wherein a tapering of the bore is linear.

3. The camshaft adjuster as recited in claim 1 wherein a tapering of the bore is nonlinear.

4. The camshaft adjuster as recited in claim 1 wherein the bore has a cylindrical portion and a tapering portion.

5. The camshaft adjuster as recited in claim 1 wherein the bore has a cylindrical portion and a tapering portion and the threaded bushing projects into the cylindrical portion.

6. The camshaft adjuster as recited in claim 1 wherein a tapered end of the bore is placed on a side of a screw head of the screw.

* * * * *